United States Patent [19]

Pennati

[11] Patent Number: 4,823,726

[45] Date of Patent: Apr. 25, 1989

[54] INFLATABLE BOAT WITH A RIGID OR SEMIRIGID KEEL AND A CATAMARAN OR TRIMARAN BOTTOM, AND WITH GUIDES ARRANGED FLUSH WITH THE BOAT FLOOR

[76] Inventor: Giuseppe Pennati, Corso Lodi, 29, 20135 - Milano, Italy

[21] Appl. No.: 15,424

[22] Filed: Feb. 17, 1987

[30] Foreign Application Priority Data

Feb. 19, 1986 [IT] Italy ..... 20991/86[U]

[51] Int. Cl.[4] ..... B63B 7/00

[52] U.S. Cl. ..... 114/345

[58] Field of Search ..... 114/56, 61, 345; 441/40

[56] References Cited

U.S. PATENT DOCUMENTS 4,231,131 11/1980 Young ..... 114/345
4,624,208 11/1986 Hyne ..... 441/40
4,640,217 2/1987 Ferroniere ..... 114/345

*Primary Examiner*—Joseph F. Peters, Jr.
*Assistant Examiner*—Jesus D. Sotelo
*Attorney, Agent, or Firm*—Bucknam and Archer

[57] ABSTRACT

The inflatable boat comprises a catamaran or trimaran bottom and, on the boat floor, longitudinal sliding guides for locking at the desired portions, and without the need of making holes, all of the members usually arranged on the boat floor such as the driving quarter-deck, middle peak, vessels and the like.

1 Claim, 3 Drawing Sheets

INFLATABLE BOAT WITH A RIGID OR SEMIRIGID KEEL AND A CATAMARAN OR TRIMARAN BOTTOM, AND WITH GUIDES ARRANGED FLUSH WITH THE BOAT FLOOR

BACKGROUND OF THE INVENTION

The present invention relates to an inflatable boat, with catamaran or trimaran bottom, made of rigid or semirigid materials, of any suitable types, and including guides arranged flush with the boat floor level, for the sliding and locking, at the desired positions, of the quarter-deck, peaks with seats and the like.

As is known, inflatable boats usually consist of a flat bottom which is supported for floating by tubular members, perimetrically arranged with respect to the bottom itself.

Also known is the fact that conventional inflatable boats are affected by some drawbacks relating to the lift, depending on the different loads on the boat.

Moreover since, depending on the load, undesired attitude variations may occur, the user is compelled to choose a proper driving power, depending on the provided loads, in order to prevent power waste from occurring.

SUMMARY OF THE INVENTION

Accordingly, the main object of the present invention is to overcome the above mentioned drawbacks, by providing an inflatable boat having a rigid trimaran or catamaran structure capable of automatically adjusting the lift to the loads imposed on the boat.

Another object of the invention is to provide an inflatable boat adapted for receiving driving assemblies of broadly varying driving powers.

Another object of the invention is to provide such an inflatable boat which is capable of holding a substantially constant attitude even if its driving power is changed.

According to one aspect of the present invention, the above objects, as well as yet other objects, which will become more apparent hereinafter, are achieved by an inflatable boat, characterized in that it comprises a catamaran or trimaran bottom made of rigid or semirigid materials and including longitudinal sliding guides for locking, at the desired positions, and without the need of making holes, all of the members usually arranged on the boat floor.

BRIEF DESCRIPTION OF THE DRAWINGS

Further characteristics and advantages of the inflatable boat according to the present invention will become more apparent from the following description of a preferred embodiment thereof, being illustrated, by way of an indicative example, in the figures of the accompanying drawings, where.

DESCRIPTION OF THE PREFERRED EMBODIMENT

Figure 1:
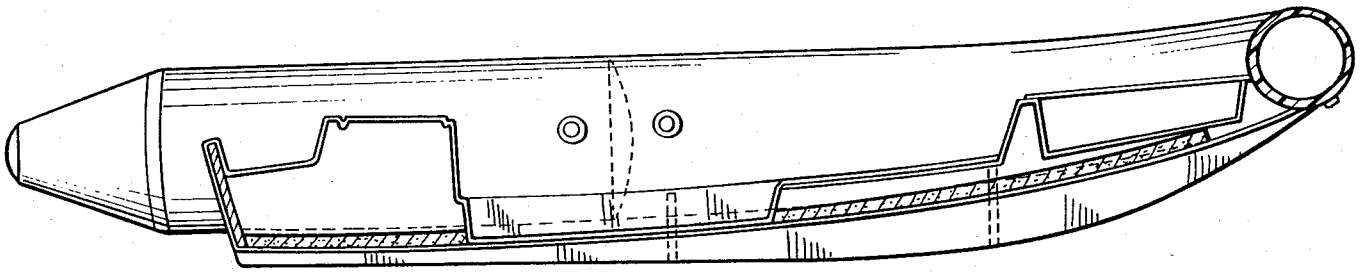
FIG. 1 is a longitudinal cross-section view of the inflatable boat according to the invention.
Figure 2:
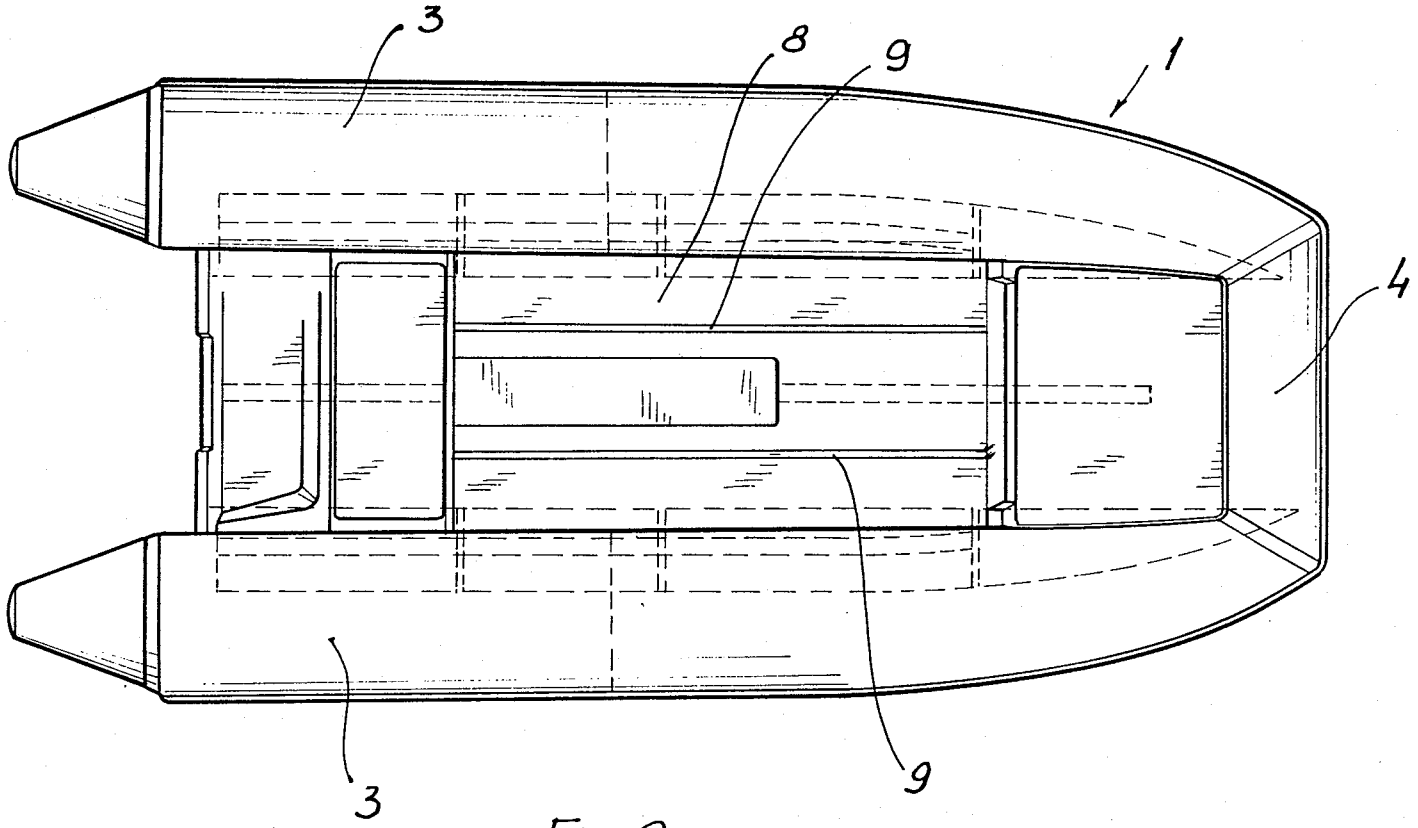
FIG. 2 is a schematic top view of that same inflatable boat.
Figure 3:
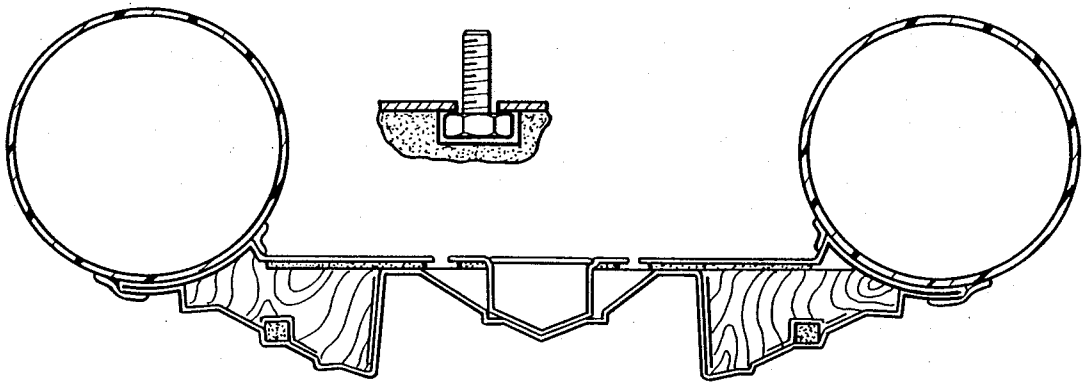
FIG. 3 is a cross-sectional view of the inflatable boat according to the invention.

With reference to the figures, the inflatable boat according to the present invention, indicated generally at 1, essentially comprises a suitably designed bottom 2, on the outside of which there are longitudinally restrained tubular elements 3 which, at the bow, are mutually coupled by a further tubular element 4 for providing, in cooperation with said tubular elements 3, the lifting or floating force to the boat.

More specifically, the boat bottom 2 is provided with two lower side ridges 5, which are stiffened by suitable stringers 6 designed to assume an attitude like that of a catamaran.

The boat bottom 2, moreover, may also be provided with a keel 7 downward projecting with a diehedral cross-section portion, so as to present the characteristics of a trimaran.

Preferably the keel projects only at the aft portion of the boat, to increase the boat lift under full load conditions of the boat itself.

Thus, it will be possible to automatically adjust the lift of the inflatable boat depending on the loads imposed thereon.

In other words, as the boat passenger load (mainly exerted at the aft portion of the boat) increases, the keel will be pushed to a greater depth into the water but, owing to the keel protruding shape at the aft portion of the boat, the dynamic thrust of the water will be correspondingly increased, so as to "automatically" fit the boat attitude to the new load conditions.

Moreover, the provision of a trimaran bottom allows for the inflatable boat to hold a constant attitude, even if the driving power is changed.

It should moreover be pointed out that the central portion of the trimaran keel is such as to provide a drift effect, thereby smoothing the wave impact and increasing the boat lift.

Flush with the boat floor 8 there are provided two steel parallel guides 9, longitudinally arranged and having a substantially omega-shaped cross-section.

These guides afford the possibility of locking at the desired positions, by chanelled bolts and the like, all the desired members (such as the driving quarter-deck, middle peak, auxiliary tanks, vessels and so on) without the need of making holes.

While the invention has been disclosed with reference to a preferred embodiment thereof, it should be apparent that it is susceptible to modifications and variations all of which come within its scope and spirit.

I claim:

1. An inflatable boat, comprising a bottom made of substantially rigid materials and including longitudinal sliding guides for locking, at the desired positions, and without the need of making holes, all of the members usually arranged on the boat floor, on the outside of said bottom there being provided longitudinally restrained tubular elements which, at the bow, are mutually coupled by a further tubular element, wherein said bottom is provided with a downward projecting keel having a diehedral cross-section portion so as to assume the attitude of a trimaran, said keel projecting exclusively at the boat aft zone to increase the full load lift, said bottom being further provided with two lower side ridges stiffened by stringer members, so as to assume an attitude like that of a trimaran.

* * * * *